United States Patent [19]

Ammerling et al.

[11] 4,401,294

[45] Aug. 30, 1983

[54] APPARATUS FOR COILING AND COOLING WIRE ROD

[75] Inventors: Willi J. Ammerling, Erkrath; Alfred Muller, Meerbusch-Lank, both of Fed. Rep. of Germany

[73] Assignee: SMS Schloemann-Siemag Aktiengesellschaft, Dusseldorf, Fed. Rep. of Germany

[21] Appl. No.: 341,494

[22] Filed: Jan. 21, 1982

[30] Foreign Application Priority Data

Feb. 4, 1981 [DE] Fed. Rep. of Germany ..... 3103671

[51] Int. Cl.[3] ..... C21D 9/573

[52] U.S. Cl. ..... 266/112; 266/106; 266/259; 148/156

[58] Field of Search ..... 266/111, 112, 113, 249, 266/259, 260, 106; 72/201; 148/153, 156; 134/117, 121

[56] References Cited

U.S. PATENT DOCUMENTS

| | | | |
|---|---|---|---|
| 2,777,683 | 1/1957 | Ferguson | 266/132 |
| 3,039,432 | 6/1962 | Boutillier et al. | 118/421 |
| 3,121,646 | 2/1964 | Smart | 118/704 |
| 3,604,691 | 9/1971 | Sherwood | 266/112 |
| 3,643,627 | 2/1972 | Killin et al. | 118/421 |
| 3,669,762 | 6/1972 | Takeo et al. | 148/18 |
| 4,024,745 | 5/1977 | Karlberger | 72/201 |

FOREIGN PATENT DOCUMENTS

| | | | |
|---|---|---|---|
| 162176 | 9/1964 | U.S.S.R. | 134/117 |

*Primary Examiner*—L. Dewayne Rutledge
*Assistant Examiner*—Christopher W. Brody
*Attorney, Agent, or Firm*—Holman & Stern

[57] ABSTRACT

Apparatus for coiling and cooling wire rod comprises a turn-laying head, a coil receiver below the head, movable downwards to maintain a constant distance between the head and the top of the coil, and a cooling tank which is vertically movable. In an upper position the cooling tank contains the coil receiver and coil, and in a lower position the cooling tank is lower than the coil receiver, so that the coil can be conveyed horizontally away from the coil receiver. A coil mandrel is mounted in the cooling tank. Two such devices can be provided side by side with a common drive arranged to raise one cooling tank while lowering the other.

7 Claims, 2 Drawing Figures

APPARATUS FOR COILING AND COOLING WIRE ROD

BACKGROUND OF THE INVENTION

1. Field of the Invention

The invention relates to apparatus for coiling and cooling wire rod or rolled wire, comprising a rotating turn-laying head and a coil receiver for collecting the wire turns which is located below the laying head in a cooling tank.

2. Description of the Prior Art

In modern wire rod mills, steel wire rod of middle to high carbon content is patented by controlled cooling from the rolling temperature, in order to improve the drawing properties. In this respect, it is known either to cool the wire turns formed by the laying head in a fanned-out arrangement on a conveyor belt using air, or to allow them to fall directly into a water bath and to collect them into coils.

German Patent Specification No. OS 2602696 discloses apparatus for coiling and cooling wire rod in which, in order to satisfy high discharge speeds in a wire rod mill, guides are disposed in a cooling liquid tank rotatable about a vertical axis, for receiving three wire coils which can be brought sequentially under a rotating turn-laying head. By rotating the cooling liquid tank, the wound wire coils arrive under an overhead travelling crane which lifts them out of the tank and conveys them away.

This device is costly. The step-wise rotation of the tank filled with cooling medium and two coils requires a large drive power.

A further drawback of this device is that the distance of the laying head from the coil surface cannot be kept constant, as is necessary for uniform winding, but instead it becomes smaller as the coil becomes larger. A further drawback is that a special overhead travelling crane with a costly manually inserted gripping device must be available for lifting the coils and conveying them away.

The object of the invention is to provide a simple and operationally reliable device for coiling and cooling wire rod, in which the distance from the laying head to the coil surface can be held at a constant small value, and the extraction of the coil can be carried out rapidly, automatically and in an operationally reliable manner.

SUMMARY OF THE INVENTION

This is attained according to the invention in that during the winding process, the coil receiver can be lowered continuously inside the cooling tank from an upper position corresponding to its optimum distance from the turn laying head so as to compensate for the coil growth during the coiling operation, until a lower position allowing transverse conveying of the coil is reached, the cooling tank being withdrawable downwards below the transverse conveying plane for the coil.

With this proposed simple device, during coiling an optimum small distance between the turn laying head and the upper surface of the growing coil can be maintained. The finished coil is in the plane in which it is conveyed away, with no height variations, so that no special lifting device is required. Extraction of the coil can be carried out automatically and rapidly by means of known lifting or walking beam conveyors, so that high operational reliability is attained.

In order to centre the turns, a mandrel, with which a passage opening in the centre of the coil receiver is associated, can be fixed vertically to the cooling tank base.

The coil receiver is preferably disposed on a crank-shaped arm which is perpendicular to the cooling tank wall and is movable by means of a chain or other drive on a vertical guide.

A rack drive, cable winch or pressure-medium lifting cylinder can advantageously be provided as the drive for the vertically guided cooling tank.

In order to attain good accessibility for repair and maintenance work, the tank and its guide and drive means can be made mobile horizontally away from the vicinity of the turn-laying head and the coil receiver.

If two such devices are used in a coupled arrangement for coiling and cooling, the two cooling tanks are preferably adjustable in level in opposite directions by means of a common drive. As a result of this weight balance between the two cooling tanks only a small drive power is necessary for adjusting their levels.

BRIEF DESCRIPTION OF THE DRAWINGS

One embodiment of the invention is shown in the accompanying drawings, in which.

DESCRIPTION OF THE PREFERRED EMBODIMENTS

Figure 1:
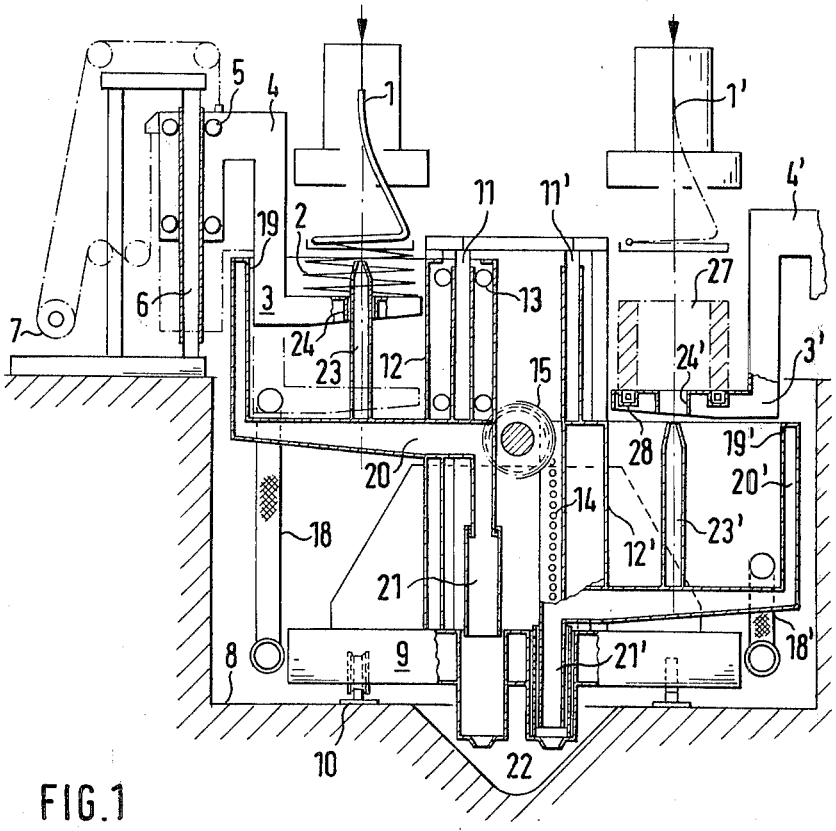
FIG. 1 shows two adjacently disposed devices for coiling and cooling wire rod.
Figure 2:
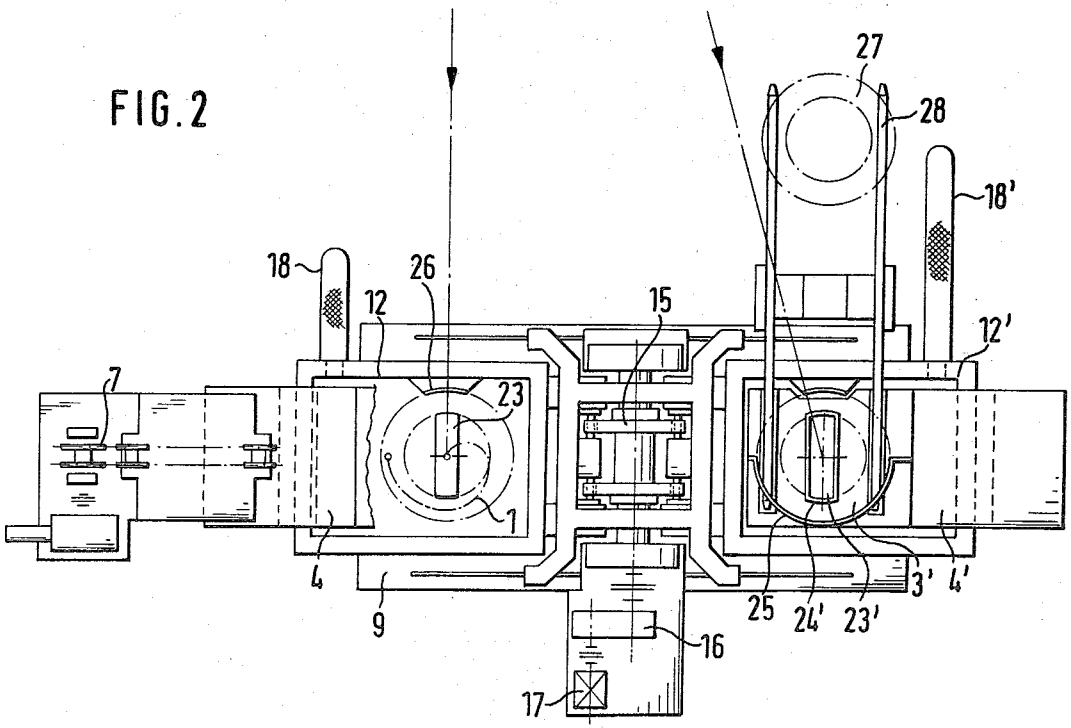
FIG. 2 is a plan view of the apparatus of FIG. 1, also showing a device for removing the wound coils.

In the illustrated embodiment, the wire is fed from above into turn-laying heads 1, 1'. The formed wire turns 2 fall onto one or the other of two coil receivers 3 and 3' respectively, disposed on respective cranked arms 4, 4'. The arms 4 and 4' are each movable by means of rollers 5 on a stationary vertical guide 6, and are each connected to a respective drive chain 7.

A truck 9 is movable on rollers on rails 10 in a recess 8 in the foundations. The truck 9 is provided with vertical guides 11, 11', on each of which a cooling tank 12, 12' can move vertically by way of rollers 13. The cooling tanks 12, 12' are each provided on their sides with rack toothing 14, in which a toothed wheel 15 journalled on the truck 9 meshes by means of opposing teeth to raise and lower the tanks. The toothed wheel 15 is connected by way of a transmission device or gear unit 16 to a motor 17. By means of this common opposite-motion drive for the cooling tanks 12, 12', a state of weight balance exists between the two tanks so that the motor 17 can be of low power. The rails 10 and rollers enable the tanks to be moved horizontally away from the turn-laying heads and the coil receivers, together with the guiding and drive means associated with the tanks.

A cooling medium feed line 18, 18' is connected to the cooling tanks 12, 12' respectively, in the vicinity of their bases. A respective overflow 19, 19' is provided at the top of the tank walls, and opens into a channel 20, 20' provided about the tanks 12, 12' respectively, and to which a telescopic down-pipe 21, 21' is connected below each cooling tank 12, 12' respectively. A channel 22 which leads to a cooling water processing system, not shown, is provided in the foundations below the down pipes 20, 20'.

During coil winding, the operative coil receiver 3 is kept below the water surface inside the operative cooling tank 12 so that the wire turns 2 fall reliably into the cooling water in the tank. A flat mandrel 23, 23', associated with a through opening 24, 24' in the coil receiver 3, 3' respectively, is fixed in each cooling tank 12, 12' for centering the wire turns 2. Guide plates 25 and 26 are disposed on the coil receivers 3, 3' and in the cooling tanks 12, 12'. As the coil 27 increases in height, the coil receiver 3 is lowered, so that a constant distance is maintained between the coil surface and laying head and all turns 2 fall into the water in tank 12.

As soon as the winding of the coil 27 is finished, the cooling tank containing it is lowered by rotating the toothed wheel 15, so that the coil 27 is released from the mandrel and tank and can be conveyed away by means of a lifting beam conveyor 28 which extends into the region of the coil receiver 3, 3'. The other cooling tank 12' is simultaneously raised by the wheel 15 into a position surrounding the other coil receiver 3', which receiver is raised by its drive chain towards the laying head 1', so that a coil can be wound on the receiver 3'. When this coil is complete the tank 12' is lowered, the coil is removed, and winding recommences on receiver 3 in cooling tank 12.

The invention is not limited to the illustrated embodiment. Thus, the opposing vertical movement of the two cooling tanks 12, 12' can for example be attained by means of a hydraulic cylinder by way of a double-arm lever.

We claim:

1. Apparatus for cooling and coiling wire rod, comprising a rotary turn-laying head for forming a coil, a coil receiver below the turn-laying head for receiving the turns from the head and carrying the coil formed thereby, means for moving the coil receiver down relative to the turn-laying head from an upper position to a lower position, and a cooling tank mounted for movement between an upper position in which the tank surrounds the coil receiver and a coil carried thereby, and a lower portion in which the tank is below a predetermined level permitting a complete coil to be removed sideways from the coil receiver.

2. Apparatus as claimed in claim 1 in which the cooling tank has a base and a vertical mandrel is fixed to and extends upwards from the tank base, and the coil receiver has an opening therein for receiving the mandrel.

3. Apparatus as claimed in claim 1 in which the cooling tank has a side wall, and comprising a perpendicularly cranked arm corresponding to the said side wall, the coil receiver being provided on said arm, a vertical guide for the arm, and a controllable lifting drive for moving the arm along said guide.

4. Apparatus as claimed in claim 1, in which the tank is movable up and down by a rack drive, a cable winch or a pressure-medium cylinder.

5. Apparatus as claimed in claim 1, including means for moving the tank horizontally away from the vicinity of the laying head and coil receiver.

6. In combination, two coiling and cooling apparatuses as claimed in claim 1 having a common drive arranged to effect up and down movement of the respective cooling tanks simultaneously in opposite directions.

7. The apparatus claimed in claim 6 in which the respective means for moving the coil receivers are independently operable.

* * * * *